US009806499B2

(12) United States Patent
Terada

(10) Patent No.: US 9,806,499 B2
(45) Date of Patent: Oct. 31, 2017

(54) SPARK PLUG FOR INTERNAL COMBUSTION ENGINE

(71) Applicant: DENSO CORPORATION, Kariya, Aichi-pref. (JP)

(72) Inventor: Kanechiyo Terada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/501,575

(22) PCT Filed: Jul. 28, 2015

(86) PCT No.: PCT/JP2015/071396
§ 371 (c)(1),
(2) Date: Feb. 3, 2017

(87) PCT Pub. No.: WO2016/021445
PCT Pub. Date: Feb. 11, 2016

(65) Prior Publication Data

US 2017/0237236 A1 Aug. 17, 2017

(30) Foreign Application Priority Data

Aug. 5, 2014 (JP) ..... 2014-159196

(51) Int. Cl.
*H01T 13/32* (2006.01)

(52) U.S. Cl.
CPC ..... *H01T 13/32* (2013.01)

(58) Field of Classification Search
CPC ..... H01T 13/02; H01T 13/04; H01T 13/20; H01T 13/32
See application file for complete search history.

(56) References Cited

U.S. PATENT DOCUMENTS

| | | | | |
|---|---|---|---|---|
| 8,729,784 | B2 * | 5/2014 | Rohrbach | H01T 13/20 123/169 R |
| 8,841,825 | B2 * | 9/2014 | Yamanaka | H01T 13/20 313/141 |
| 9,059,571 | B2 * | 6/2015 | Hartmann | H01T 13/20 |
| 9,234,491 | B2 * | 1/2016 | Aochi | F02P 15/001 |
| 2008/0088216 | A1 | 4/2008 | Kim | |
| 2012/0299458 | A1 | 11/2012 | Aochi et al. | |
| 2013/0015755 | A1 | 1/2013 | Inohara et al. | |
| 2013/0214668 | A1 | 8/2013 | Aochi et al. | |

(Continued)

FOREIGN PATENT DOCUMENTS

| | | |
|---|---|---|
| JP | 2003-068420 | 3/2003 |
| JP | 2007-273421 | 10/2007 |

(Continued)

*Primary Examiner* — Anne Hines
(74) *Attorney, Agent, or Firm* — Nixon & Vanderhye PC

(57) ABSTRACT

A spark plug 1 includes a tubular housing 2, a tubular insulator 3 held inside the housing 2, a center electrode 4 held inside the insulator 3 such that a distal end portion 41 protrudes, a ground electrode 5 that forms a spark discharge gap G between it and the center electrode 4, and a standing member 6 that stands distalward from a distal end portion 21 of the housing 2. In at least one of a pair of side surfaces 61 of the standing member 6 which face in a plug circumferential direction, there is formed a guide step portion 62 for guiding the flow of an air-fuel mixture in a combustion chamber of an internal combustion engine to the spark discharge gap G.

6 Claims, 13 Drawing Sheets

(56) References Cited

U.S. PATENT DOCUMENTS

| | | | |
|---|---|---|---|
| 2014/0159563 | A1 | 6/2014 | Shibata et al. |
| 2015/0318671 | A1 | 11/2015 | Aochi et al. |
| 2016/0053733 | A1 | 2/2016 | Aochi et al. |

FOREIGN PATENT DOCUMENTS

| | | |
|---|---|---|
| JP | 2008-204882 | 9/2008 |
| JP | 2011-187437 | 9/2011 |
| JP | 2012-256445 | 12/2012 |
| JP | 2013-016302 | 1/2013 |
| JP | 2014-107096 | 6/2014 |

* cited by examiner

SPARK PLUG FOR INTERNAL COMBUSTION ENGINE

This application is the U.S. national phase of International Application No. PCT/JP2015/071396 filed 28 Jul. 2015, which designated the U.S. and claims priority to JP Patent Application No. 2014-159196 filed 5 Aug. 2014, the entire contents of each of which are hereby incorporated by reference.

TECHNICAL FIELD

The present invention relates to spark plugs that are used as ignition means in internal combustion engines.

BACKGROUND ART

As ignition means for internal combustion engines of motor vehicles, there are known spark plugs which have a spark discharge gap formed by opposing a center electrode and a ground electrode. Such spark plugs discharge a spark in the spark discharge gap, thereby igniting an air-fuel mixture in a combustion chamber of an internal combustion engine.

In the combustion chamber, there is formed a flow of the air-fuel mixture, such as a swirl flow or tumble flow. With the flow of the air-fuel mixture moderately flowing also in the spark discharge gap, it is possible to ensure the ignition performance.

To this end, there has been disclosed a spark plug which has a protruding member provided on a distal end portion of a housing so as to guide the flow of the air-fuel mixture in the combustion chamber to the spark discharge gap (see Patent Document 1).

PRIOR ART LITERATURE

Patent Literature

[PATENT DOCUMENT 1] Japanese Patent Application Publication No. JP2013038063A

SUMMARY OF THE INVENTION

Problems to be Solved by the Invention

However, in the above spark plug disclosed in Patent Document 1, though it is possible to direct the flow of the air-fuel mixture viewed in a plug axial direction to the center of the spark plug, i.e., to the spark discharge gap, it is impossible to direct the direction of the flow of the air-fuel mixture viewed in a plug radial direction to the spark discharge gap. That is, the above spark plug does not have a function of guiding the flow of the air-fuel mixture to the spark discharge gap in the plug axial direction; therefore, there is room to improve the ignition performance.

The present invention has been made in view of the above circumstances and aims to provide a spark plug for an internal combustion engine which has an improved ignition performance.

Means for Solving the Problems

A spark plug for an internal combustion engine according to the present invention includes:

a tubular housing;

a tubular insulator held inside the housing;

a center electrode held inside the insulator such that a distal end portion protrudes;

a ground electrode that forms a spark discharge gap between it and the center electrode; and a standing member that stands distalward from a distal end portion of the housing, wherein in at least one of a pair of side surfaces of the standing member which face in a plug circumferential direction, there is formed a guide step portion for guiding the flow of an air-fuel mixture in a combustion chamber of the internal combustion engine to the spark discharge gap.

Advantageous Effects of the Invention

The above spark plug for an internal combustion engine includes the standing member. Therefore, it is possible to guide, by the guide step portion of the standing member, the flow of the air-fuel mixture to the spark discharge gap in the plug axial direction. That is, the flow of the air-fuel mixture, which advances from the radially outer side to the radially inner side in a plug radial direction along the side surfaces of the standing member, is guided by the guide step portion in the plug axial direction. Consequently, by the guide step portion, an angle of the flow of the air-fuel mixture to the plug axial direction is corrected and thus the flow of the air-fuel mixture is guided to a closer position to the spark discharge gap. As a result, it is possible to ensure the flow of the air-fuel mixture in the spark discharge gap, thereby improving the ignition performance.

As above, according to the present invention, it is possible to provide the spark plug for an internal combustion engine which has an improved ignition performance.

EMBODIMENTS FOR CARRYING OUT THE INVENTION

Figure 1:
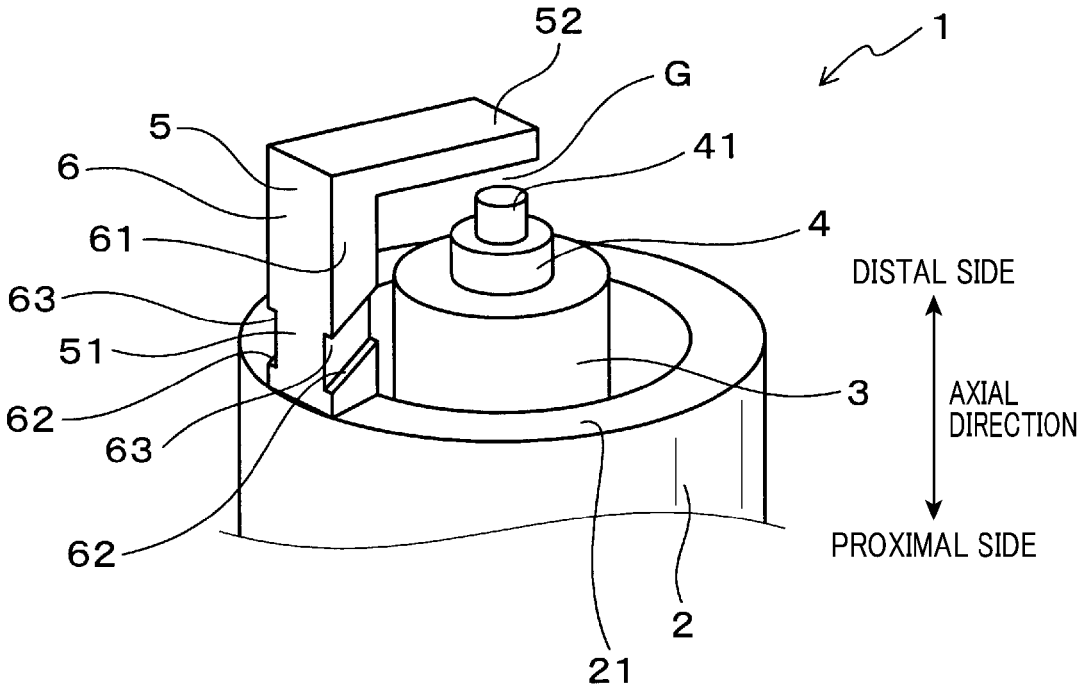
FIG. 1 is a perspective view of a distal part of a spark plug according to a first embodiment.

In the above-described spark plug for an internal combustion engine, the side to be inserted into a combustion chamber is referred to as the distal side; the opposite side is referred to as the proximal side (see FIG. 1).

Moreover, "plug axial direction", "plug radial direction" and "plug circumferential direction" respectively denote axial, radial and circumferential directions of the spark plug.

Moreover, in the above-described spark plug for an internal combustion engine, the standing member may be constituted of the ground electrode or provided separately from the ground electrode.

In the case of the standing member being constituted of the ground electrode, when the ground electrode is located upstream of the spark discharge gap with respect to the flow of the air-fuel mixture, it is possible to effectively guide, by the guide step portion, the flow of the air-fuel mixture to the spark discharge gap in the plug axial direction. In general, when the ground electrode is located upstream of the spark discharge gap with respect to the flow of the air-fuel mixture, the ground electrode becomes an obstacle to the flow of the air-fuel mixture, making it difficult for the flow of the air-fuel mixture to be introduced into the spark discharge gap. However, the flow of the air-fuel mixture passing by the ground electrode advances from the radially outer side to the radially inner side along the side surfaces of the ground electrode. At this time, since the flow of the air-fuel mixture can be guided by the guide step portion of the standing member (the ground electrode) to the spark discharge gap in the plug axial direction, it is possible to effectively suppress stagnation of the flow of the air-fuel mixture in the spark discharge gap. As a result, it is possible to ensure a stable ignition performance of the spark plug.

It is preferable for the above-described spark plug to have a protruding member that stands (protrudes) from a different position at the distal end portion of the housing from the ground electrode. In this case, if the protruding member stands adjacent to a standing portion of the ground electrode in the plug circumferential direction, it is possible to guide, by the protruding member, the flow of the air-fuel mixture in a direction toward the spark discharge gap as viewed along the plug axial direction. Thus, it is possible to perform both the function of guiding the flow of the air-fuel mixture viewed along the plug axial direction by the protruding member and the function of guiding the flow of the air-fuel mixture viewed from a side of the standing member by the guide step portion of the standing member. As a result, it is possible to further suppress variation in the ignition performance due to the mounting posture of the spark plug to the internal combustion engine, thereby securing a more stable ignition performance. That is, with the provision of the function of guiding the flow of the air-fuel mixture by the standing member in addition to the function of guiding the flow of the air-fuel mixture in the spark plug disclosed in the above-described Patent Document 1, it is possible to further improve the stability of the ignition performance.

Moreover, the standing member may also be constituted of the protruding member. In this case, when the standing member, which is different from the ground electrode, is located upstream of the spark discharge gap with respect to the flow of the air-fuel mixture, it is possible to effectively guide the flow of the air-fuel mixture to the spark discharge gap in the plug axial direction.

First Embodiment

A spark plug 1 according to the first embodiment will be described with reference to FIGS. 1-5.

Figure 2:
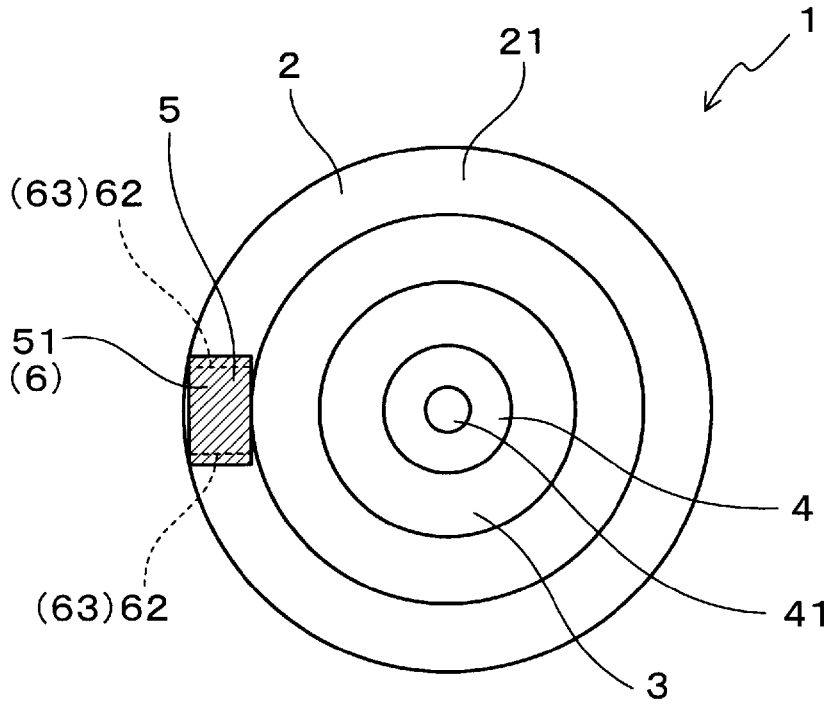
FIG. 2 is a partially cross-sectional view of the distal part of the spark plug according to the first embodiment viewed along a plug axial direction.
Figure 3:
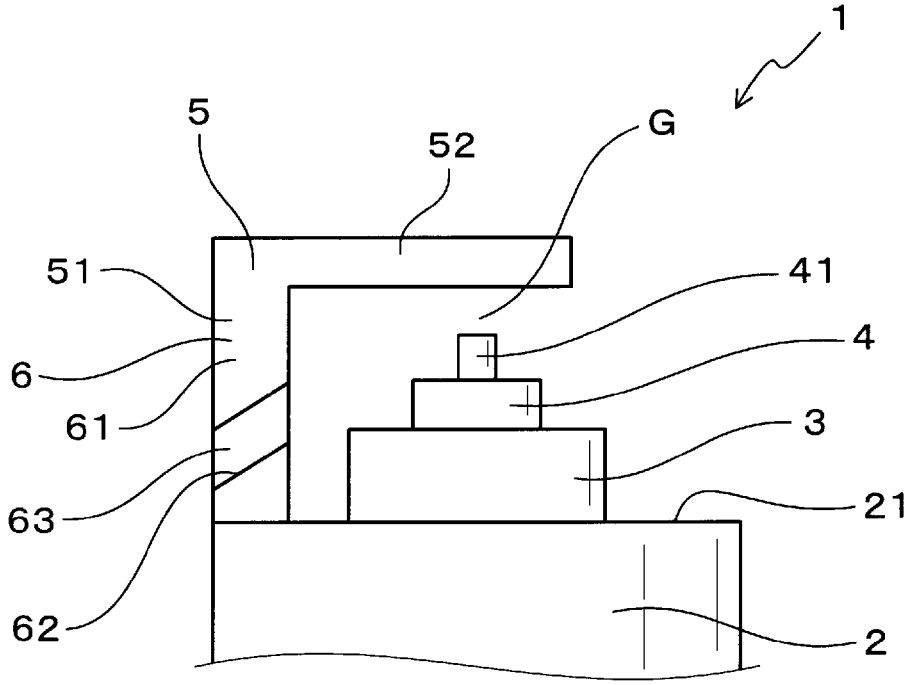
FIG. 3 is a schematic side view of the distal part of the spark plug according to the first embodiment.

As shown in FIGS. 1-3, the spark plug 1 of the present embodiment includes a tubular housing 2, a tubular insulator 3 held inside the housing 2, a center electrode 4 held inside the insulator 3 such that a distal end portion 41 protrudes, and a ground electrode 5 that forms a spark discharge gap G between it and the center electrode 4. Moreover, the spark plug 1 further includes a standing member 6 that stands distalward from a distal end portion 21 of the housing 2. In at least one of a pair of side surfaces 61 of the standing member 6 which face in the plug circumferential direction, there is formed a guide step portion 62 for guiding the flow of an air-fuel mixture in a combustion chamber of an internal combustion engine to the spark discharge gap G.

Figure 5:
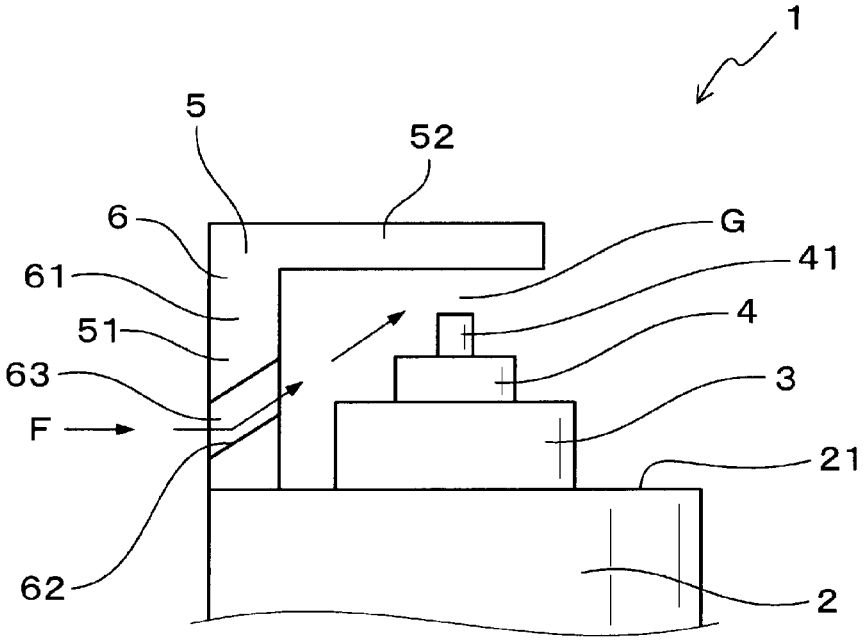
FIG. 5 is a schematic side view of the distal part of the spark plug according to the first embodiment illustrating the function of the guide step portion.

As shown in FIG. 5, the guide step portion 62 is formed so as to guide the flow F of the air-fuel mixture, which advances from the radially outer side to the radially inner side in the plug radial direction along the side surfaces 61 of the standing member 6, to the spark discharge gap G in the plug axial direction.

In the present embodiment, the standing member 6 is constituted of the ground electrode 5. That is, in the present embodiment, the guide step portion 62 is formed in the ground electrode 5 and the ground electrode 5 functions also as the standing member 6.

As shown in FIGS. 1-4, the guide step portion 62 is constituted of part of a groove portion 63 formed in the side surface 61 of the standing portion 6. That is, in the side surface 61 of the standing member 6, there is formed the groove portion 63 penetrating from the radially outer side to the radially inner side; an inner wall surface of the groove portion 63 on the proximal side in the plug axial direction constitutes the guide step portion 62.

In addition, in the case where the slanting direction of the groove portion 63 is, opposite to the present embodiment, toward the proximal side while advancing from the radially outer side to the radially inner side, an inner wall surface of the groove portion 63 on the distal side in the plug axial direction constitutes the guide step portion 62.

Figure 4:
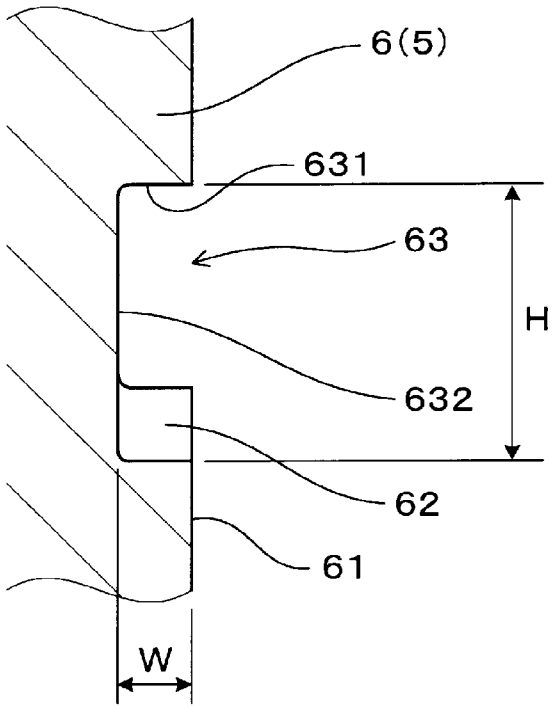
FIG. 4 is a schematic cross-sectional view of a guide step portion in the spark plug according to the first embodiment.

As shown in FIG. 4, the groove portion 63 includes the guide step portion 62, a distal-side inner wall surface 631 facing the guide step portion 62, and a groove bottom surface 632 formed therebetween. The groove bottom surface 632 is substantially parallel to the side surface 61, while the guide step portion 62 and the distal-side inner wall surface 631 are substantially perpendicular to the side surface 61. Moreover, corners between the groove bottom surface 632 and the guide step portion 62 and between the groove bottom surface 632 and the distal-side inner wall surface 631 have a curved-surface shape to suppress decrease in strength due to the notch effect. The radius of curvature of the curved surface is, for example, in the range of 0.05-0.3 mm.

As shown in FIG. 3, the guide step portion 62 is slanted so as to approach the spark discharge gap G in the plug axial direction while extending from the radially outer side to the radially inner side. The guide step portion 62 is formed on the proximal side of the spark discharge gap G. Therefore, the guide step portion 62 is slanted so as to be directed distalward while extending from the radially outer side to the radially inner side.

As shown in FIGS. 1 and 3, the ground electrode 5 has a standing portion 51 and an opposing portion 52. The standing portion 51 stands distalward from the distal end portion 21 of the housing 2. The opposing portion 52 is bent from a distal end of the standing portion 51 and has an opposing surface that opposes the distal end portion 41 of the center electrode 4 in the plug axial direction. The groove portion 63 is formed in each side surface 61 of the standing portion 51 that constitutes the standing member 6. Moreover, as shown in FIG. 2, the shape of a cross section of the standing portion 51 (the standing member 6) taken along a plane perpendicular to the longitudinal direction (the plug axial direction) is a substantially rectangular shape.

As shown in FIG. 3, when the standing member 6 is viewed from the side surface 61 side, the groove portion 63 is slanted with respect to the plug axial direction and the spark discharge gap G is located on an extension line of a centerline of the groove portion 63.

In addition, it is preferable that a width W of the guide step portion 62 in the plug circumferential direction as shown in FIG. 4 is greater than or equal to 0.2 mm. In other words, it is preferable that at the guide step portion 62, the level difference provided on the side surface 61 of the standing member 6 is greater than or equal to 0.2 mm. In still other words, it is preferable that the depth of the groove portion 63 is greater than or equal to 0.2 mm. Moreover, the greater the width W of the guide step portion 62, the easier it is to increase the effect of guiding the flow of the air-fuel mixture in the plug axial direction. However, the width W is suitably set in consideration of the maximum and minimum widths of the standing member 6. Specifically, if the maximum width of the standing member 6 is too large, the flow of the air-fuel mixture may be excessively blocked by the standing member 6; if the minimum width of the standing member 6 is too small, there may be a problem with the strength of the standing member 6. The width W of the guide step portion 62 is set in consideration of the above factors. For example, it is preferable to set the width W to be less than or equal to half of the width of the standing member 6 in the plug circumferential direction.

In addition, an upper limit of the depth of the groove portion 63 (the width W of the guide step portion 62) may be set to, for example, about 1.5 mm and a width H of the groove portion 63 may be set to be, for example, in the range of 1-4 mm. These parameters are also suitably set in consideration of the effect of guiding the flow of the air-fuel mixture and the strength of the standing member 6.

Methods of forming the groove portion 63 are not particularly limited. For example, the groove portion 63 may be formed by performing cutting, compression molding or punching on a prismatic metal bar that constitutes the standing member 6 (the ground electrode 5). In the case of performing punching, the metal bar may be arranged and fixed in a slanted state to a fixed die; then, a movable die may be vertically moved to form the groove portion 63 that is slanted with respect to an axial direction of the metal bar.

Moreover, it is preferable that the inner surfaces (the guide step portion 62, the groove bottom surface 632 and the distal-side inner wall surface 631) are mirror-finished. In this case, it is preferable to set the surface roughness of the inner surfaces of the groove portion 63 to be, for example, less than or equal to 6.3 z in ten-point average roughness Rz according to JIS B0601-1994.

Next, advantageous effects of the present embodiment will be described.

The above spark plug 1 for an internal combustion engine includes the standing member 6. Therefore, as shown in FIG. 5, it is possible to guide, by the guide step portion 62 of the standing member 6, the flow F of the air-fuel mixture to the spark discharge gap G in the plug axial direction. That is, the flow F of the air-fuel mixture, which advances from the radially outer side to the radially inner side in the plug radial direction along the side surfaces 61 of the standing member 6, is guided by the guide step portion 62 in the plug axial direction. Consequently, by the guide step portion 62, an angle of the flow F of the air-fuel mixture to the plug axial direction is corrected and thus the flow F of the air-fuel mixture is guided to a closer position to the spark discharge gap G. As a result, it is possible to ensure the flow of the air-fuel mixture in the spark discharge gap G, thereby improving the ignition performance.

In addition, as shown in FIG. 3, it is preferable that when viewed from a side of the standing member 6, an extension line of the guide step portion 62 extends to the vicinity of a distal end of the distal end portion 41 of the center electrode 4, more particularly to the vicinity of a corner of the distal end portion 41 which is on the side closer to the standing member 6. The slanting angle and formation position of the guide step portion 62 are suitably set according to the flow rate and flow speed of the air-fuel mixture and other conditions.

Moreover, in the present embodiment, the standing member 6 is constituted of the ground electrode 5; therefore, when the ground electrode 5 is located upstream of the spark discharge gap G with respect to the flow F of the air-fuel mixture, it is possible to effectively guide, by the guide step portion 62, the flow F of the air-fuel mixture to the spark discharge gap G in the plug axial direction. In general, when the ground electrode 5 is located upstream of the spark discharge gap G with respect to the flow F of the air-fuel mixture, the ground electrode 5 becomes an obstacle to the flow F of the air-fuel mixture, making it difficult for the flow F of the air-fuel mixture to be introduced into the spark discharge gap G. However, the flow F of the air-fuel mixture passing by the ground electrode 5 advances from the radially outer side to the radially inner side along the side surfaces 61 of the ground electrode 5. At this time, since the flow F of the air-fuel mixture can be guided by the guide step portion 62 of the standing member 6 (the ground electrode 5) to the spark discharge gap G in the plug axial direction, it is possible to effectively suppress stagnation of the flow F of the air-fuel mixture in the spark discharge gap G. As a result, it is possible to ensure a stable ignition performance of the spark plug 1.

In addition, in the case where the ground electrode 5 (the standing member 6) is not located upstream of the spark discharge gap G with respect to the flow F of the air-fuel mixture, it is difficult for the ground electrode 5 (the standing member 6) to become an obstacle to the flow F of the air-fuel mixture, allowing the flow F of the air-fuel mixture to be sufficiently introduced into the spark discharge gap G. Therefore, it is possible to ensure the ignition performance. On the other hand, when the ground electrode 5 (the standing member 6) is located upstream of the spark discharge gap G with respect to the flow F of the air-fuel mixture, the ground electrode 5 (the standing member 6) may become an obstacle to the flow F of the air-fuel mixture, as described above; however, with the presence of the guide step portion 62, it is possible to guide the flow F of the air-fuel mixture to the spark discharge gap G in the plug axial direction, thereby effectively preventing the ignition performance from being lowered. As a result, it is possible to suppress variation in the ignition performance due to variation in the mounting posture of the spark plug 1 to the internal combustion engine.

Moreover, the guide step portion 62 is constituted of part of the groove portion 63 formed in the side surface 61 of the standing member 6. Therefore, the flow F of the air-fuel mixture guided by the guide step portion 62 flows inside the groove portion 63; thus it is possible to more reliably direct the flow F of the air-fuel mixture to the spark discharge gap G in the plug axial direction.

Moreover, the guide step portion 62 is slanted so as to approach the spark discharge gap G in the plug axial direction while extending from the radially outer side to the radially inner side. Consequently, the flow F of the air-fuel mixture guided by the guide step portion 62 can be more effectively guided to the spark discharge gap G.

As above, according to the present embodiment, it is possible to provide the spark plug 1 for an internal combustion engine which has an improved ignition performance.

Second Embodiment

Figure 6:
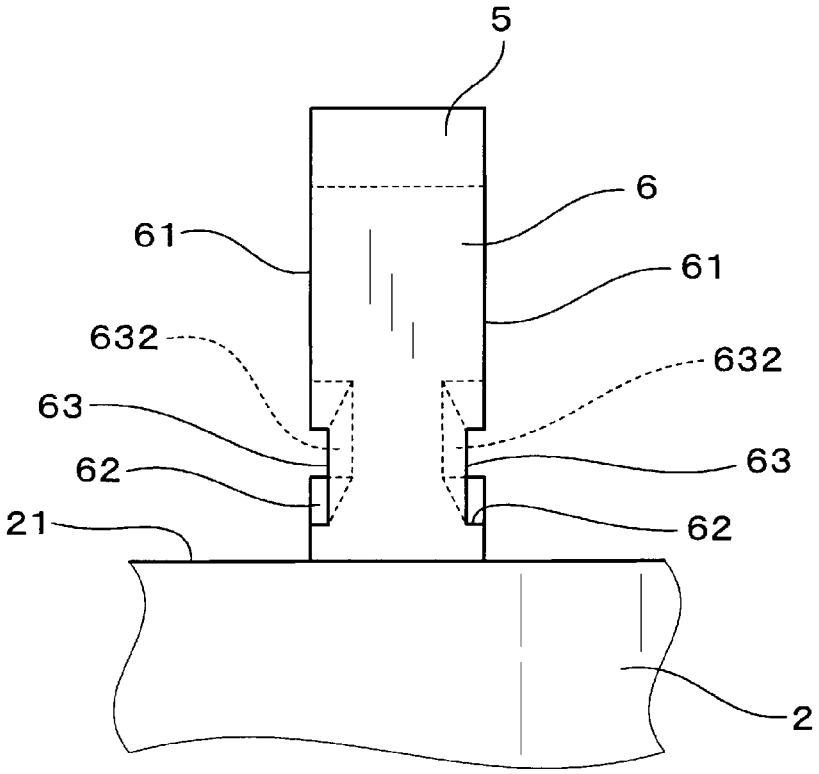
FIG. 6 is a front view, from a radially outer side, of a ground electrode constituting a standing member in a spark plug according to a second embodiment.
Figure 7:
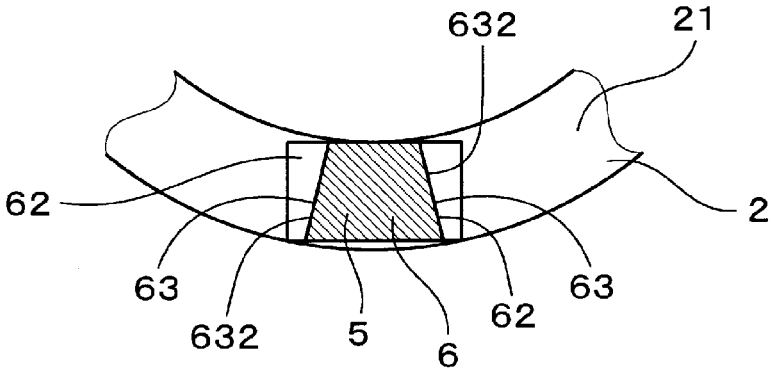
FIG. 7 is a cross-sectional view, perpendicular to the plug axial direction, of the ground electrode shown in FIG. 6.

In this embodiment, as shown in FIGS. 6 and 7, the groove portion 63 is shaped so as to be deepened while extending from the radially outer side to the radially inner side of the spark plug 1.

That is, the groove bottom surfaces 632 of the pair of groove portions 63 are slanted so as to approach each other in the plug circumferential direction while extending from the radially outer side to the radially inner side.

In addition, as in the first embodiment, the guide step portion 62 and the groove portion 63 are slanted so as to approach the spark discharge gap G in the plug axial direction while extending from the radially outer side to the radially inner side.

The other details are the same as in the first embodiment. Moreover, unless specified otherwise, of the reference signs used in the present embodiment or the drawings relating to the present embodiment, those which are the same as the reference signs used in the first embodiment designate the same components as in the first embodiment. Further, unless specified otherwise, the reference signs used in the later embodiments and drawings also designate the same components as the previous ones.

In the present embodiment, it becomes easier for the flow of the air-fuel mixture guided by the groove portion 63 to advance to the spark discharge gap G also in the course viewed along the plug axial direction. As a result, it becomes easier to guide the flow of the air-fuel mixture to the spark discharge gap G, thereby making it possible to further improve the ignition performance of the spark plug 1.

In addition, the present embodiment has the same advantageous effects as the first embodiment.

Third Embodiment

Figure 8:
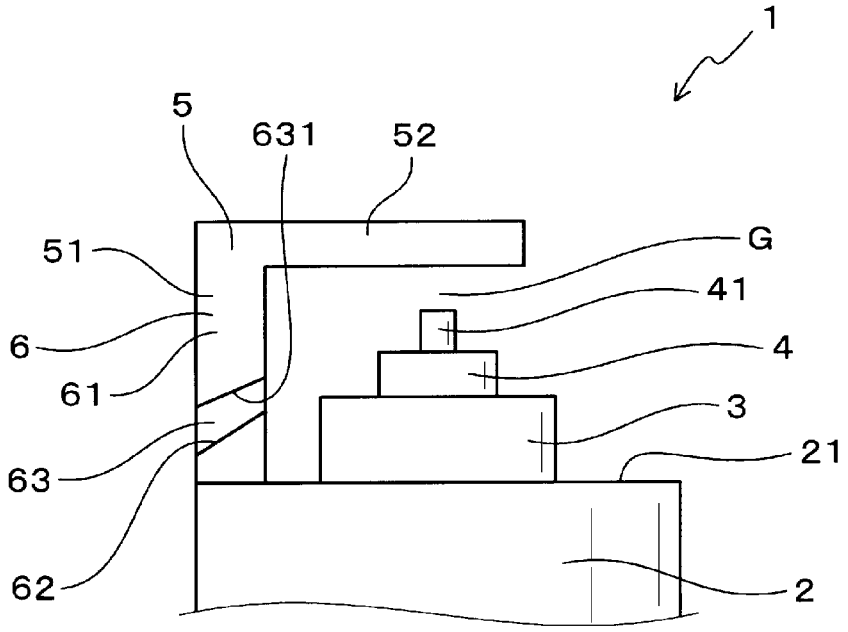
FIG. 8 is a schematic side view of a distal part of a spark plug according to a third embodiment.

In this embodiment, as shown in FIG. 8, the groove portion 63 is formed so as to be decreased in width while extending from the radially outer side to the radially inner side of the spark plug 1.

That is, the width of the groove portion 63 in the plug axial direction is narrowed as the groove portion 63 extends from the radially outer side to the radially inner side of the spark plug 1. In other words, the guide step portion 62 and the distal-side inner wall surface 631 of the groove portion 63 are not parallel to each other and the interval between them is decreased as the groove portion 63 extends from the radially outer side to the radially inner side.

The other details are the same as in the first embodiment.

In the present embodiment, when the flow of the air-fuel mixture advancing from the radially outer side to the radially inner side along the side surfaces 61 of the standing member 6 passes through the inside of the groove portion 63, since the entrance to the groove portion 63 is wider than the exit, it is easy for more the flow of the air-fuel mixture to be guided by the groove portion 63 to the spark discharge gap G.

In addition, the present embodiment has the same advantageous effects as the first embodiment.

Fourth Embodiment

Figure 9:
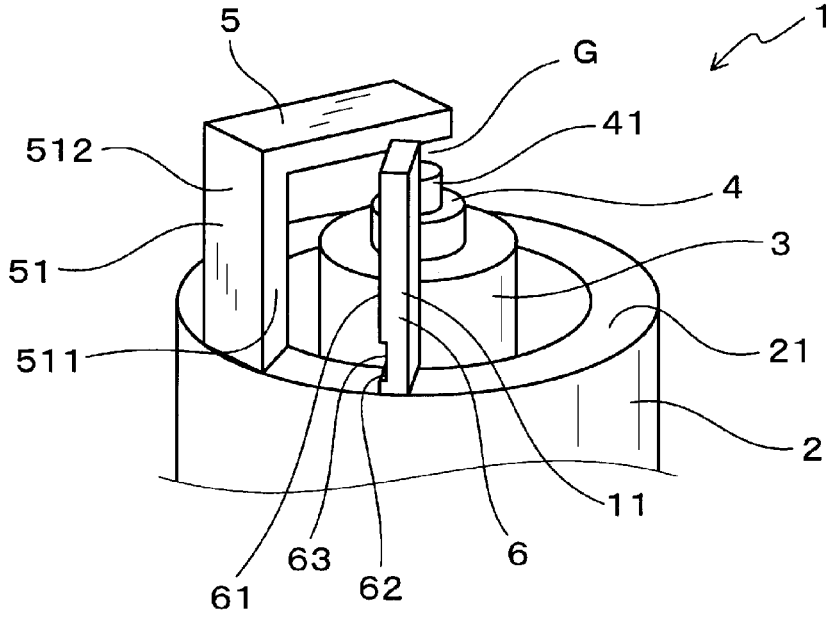
FIG. 9 is a perspective view of a distal part of a spark plug according to a fourth embodiment.
Figure 10:
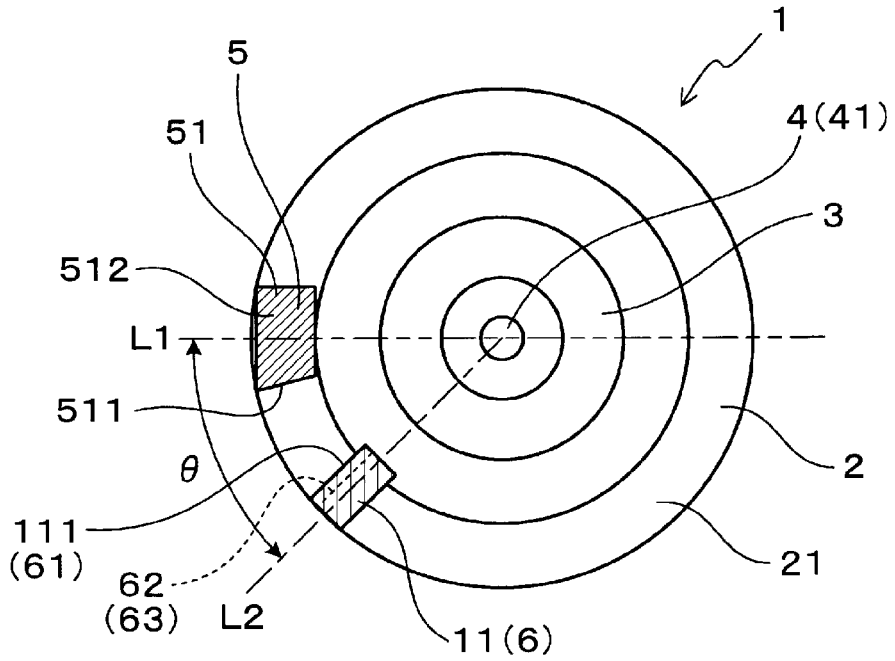
FIG. 10 is a partially cross-sectional view of the distal part of the spark plug according to the fourth embodiment viewed along the plug axial direction.
Figure 11:
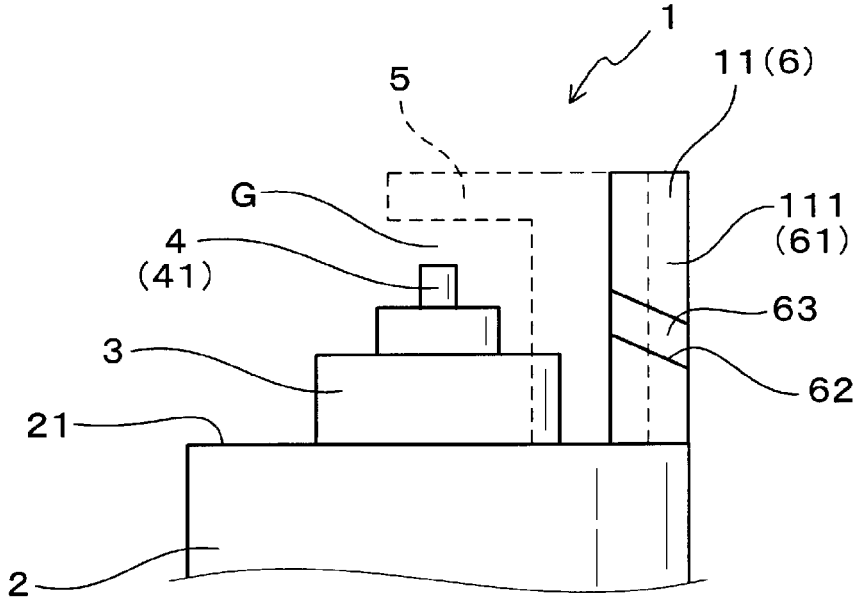
FIG. 11 is a schematic side view of the distal part of the spark plug according to the fourth embodiment.

In this embodiment, as shown in FIGS. 9-11, a protruding member 11 stands (protrudes) from a different position at the distal end portion 21 of the housing 2 from the ground electrode 5; the protruding portion 11 constitutes the standing member 6.

That is, the spark plug 1 of the present embodiment 1 includes, in addition to the ground electrode 5, the protruding member 11 that stands distalward from the distal end portion 21 of the housing 2. The protruding member 11 has a guide function of guiding the flow of the air-fuel mixture, which passes between the ground electrode 5 and the protruding member 11 from the radially outer side to the radially inner side, to the center of the spark plug 1 viewed along the plug axial direction.

As shown in FIGS. 9 and 10, the protruding member 11 is arranged at a position adjacent to the standing portion 51 of the ground electrode 5 in the plug circumferential direction. For example, the protruding member 11 is arranged at a position within 90° in the plug circumferential direction with respect to the center of the standing portion 51 of the ground electrode 5. That is, as shown in FIG. 10, when viewed along the plug axial direction, an angle θ between a straight line L1 connecting the central axis of the spark plug 1 and the center of the standing portion 51 in the plug circumferential direction and a straight line L2 connecting the central axis of the spark plug 1 and the center of the protruding member 11 in the plug circumferential direction is within 90°. Moreover, it is preferable that θ is within 45°. In the present specification, "θ in the plug circumferential direction" is construed according to the definition as per the above.

In addition, particularly in the present embodiment, the protruding member 11 is arranged at a position of substantially 45° in the plug circumferential direction with respect to the center of the standing portion 51.

The protruding member 11 constitutes the standing member 6. As shown in FIGS. 9-11, the guide step portion 62 is formed in a ground electrode 5-side side surface 61 of the protruding member 11 (the standing member 6). Moreover, the guide step portion 62 is constituted of part of the groove portion 63. The shape and formation position of the groove portion 63 are substantially the same as those in the spark plug 1 of the first embodiment.

Moreover, the standing portion 51 of the ground electrode 5 has no guide step portion 62. That is, unlike in the first embodiment, the ground electrode 5 does not constitute the standing member in the present embodiment.

Moreover, a standing member 6-side side surface 511 of the ground electrode 5 is slanted so as to make an acute angle with a back surface 512 of the ground electrode 5.

The other details are the same as in the first embodiment. In addition, FIG. 11 is a side view, from a normal direction to the side surface 61, of a distal part of the spark plug 1; however, for the sake of convenience, the side view is provided in the state of seeing through the ground electrode 5 and the ground electrode 5 only has its contour shown with dashed lines therein.

In the present embodiment, when the standing member 6 (the protruding member 11) is located upstream of the spark discharge gap G with respect to the flow F of the air-fuel mixture, it is possible to effectively guide the flow F of the air-fuel mixture to the spark discharge gap G in the plug axial direction.

Moreover, the protruding member 11 is adjacent to the standing portion 51 of the ground electrode 5 in the plug circumferential direction; therefore, when the ground electrode 5 is located upstream of the spark discharge gap G with respect to the flow F of the air-fuel mixture, it is possible to effectively guide the course of the flow F of the air-fuel mixture viewed along the plug axial direction to the center of the spark plug 1. That is, the course of the flow F of the air-fuel mixture viewed along the plug axial direction is bent by a guide surface 111 of the protruding member 11 so that the flow F of the air-fuel mixture advances to the center of the spark plug 1; the guide surface 111 is the ground electrode 5-side side surface of the protruding member 11. In this manner, the standing member 6 performs the function of guiding the direction of the flow F of the air-fuel mixture viewed along the plug axial direction to a direction toward the spark discharge gap G.

Moreover, in addition to the above function, it is also possible to guide, by the groove portion 63 including the guide step portion 62, the flow F of the air-fuel mixture along the ground electrode 5-side side surface 61 of the standing member 6 to the spark discharge gap G in the plug axial direction.

Accordingly, in the present embodiment, it is also possible to effectively suppress stagnation of the flow F of the air-fuel mixture in the spark discharge gap G. As a result, it is possible to ensure a stable ignition performance of the spark plug 1.

In addition, in the present embodiment, the guide surface 111 of the protruding member 11 is also the side surface 61 of the standing member 6 and the groove portion 63 is formed in the guide surface 111.

The present embodiment has the same advantageous effects as the first embodiment.

Fifth Embodiment

Figure 12:
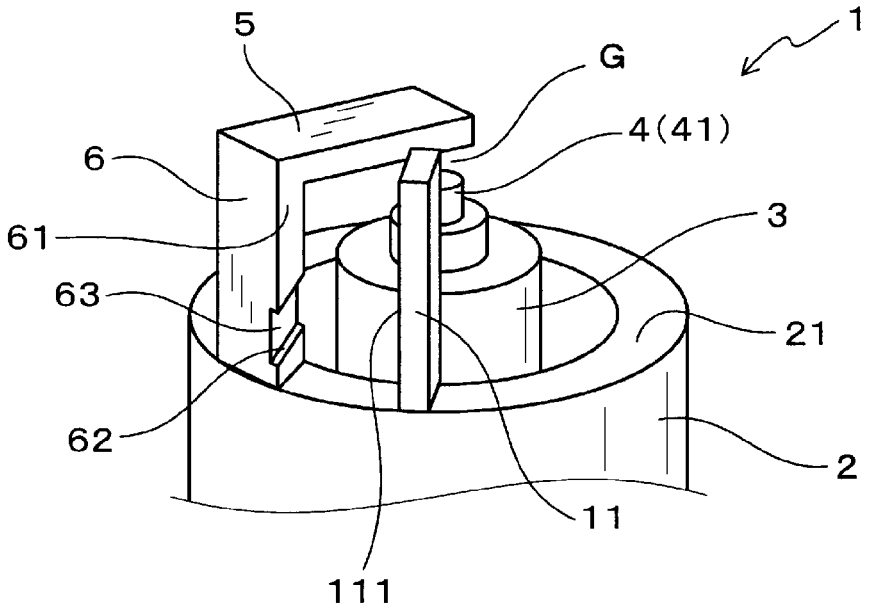
FIG. 12 is a perspective view of a distal part of a spark plug according to a fifth embodiment.
Figure 13:
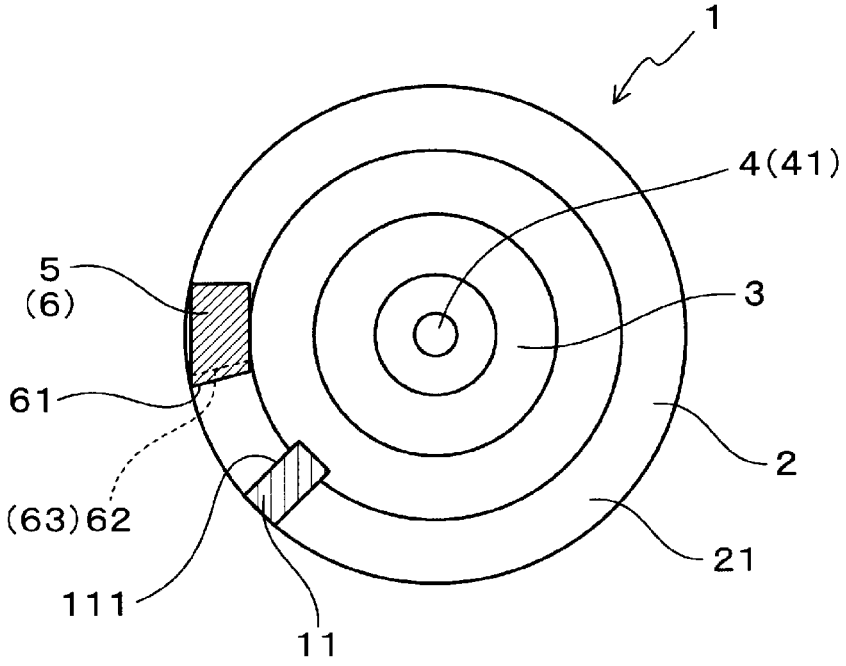
FIG. 13 is a partially cross-sectional view of the distal part of the spark plug according to the fifth embodiment viewed along the plug axial direction.

In this embodiment, as shown in FIGS. 12 and 13, the standing member 6 is constituted of the ground electrode 5 and a protruding member 11 is provided to stand from the distal end portion 21 of the housing 2.

Specifically, the protruding member 11 protrudes, at a different position from the ground electrode 5, from the distal end portion 21 of the housing 2; there is no guide step portion 62 formed in the protruding member 11. The protruding member 11 is arranged adjacent to the standing portion 51 of the ground electrode 5 in the plug circumferential direction. That is, except for having no guide step portion 62, the protruding member 11 of the spark plug 1 of the present embodiment has the same configuration and is arranged in the same manner as the protruding member 11 of the spark plug 1 of the fourth embodiment.

Moreover, the standing member 6 constituted of the ground electrode 5 has the guide step portion 62 formed in the protruding member 11-side side surface 61 thereof. The guide step portion 62 is formed as part of the groove portion 63.

The other details are the same as in the first embodiment.

The spark plug 1 of the present embodiment is configured so that in the case where the standing portion 51 of the ground electrode 5 is located upstream of the spark discharge gap G with respect to the flow F of the air-fuel mixture, the flow F of the air-fuel mixture passing by the ground electrode 5 is guided so as to approach the spark discharge gap G when viewed along the plug axial direction. That is, the course of the flow F of the air-fuel mixture viewed along the plug axial direction is bent by a guide surface 111 of the protruding member 11 so that the flow F of the air-fuel mixture advances to the center of the spark plug 1; the guide surface 111 is the ground electrode 5-side side surface of the protruding member 11.

Moreover, it is possible to guide, by the guide step portion 62, the flow F of the air-fuel mixture advancing from the radially outer side to the radially inner side along the protruding member 11-side side surface 61 of the ground electrode 5 (the standing member 6) to the spark discharge gap G in the plug axial direction.

As above, when the ground electrode 5 is located upstream of the spark discharge gap G with respect to the flow F of the air-fuel mixture, it is possible to effectively guide the flow F of the air-fuel mixture to the spark discharge gap G, thereby making it easy to ensure a stable ignition performance of the spark plug 1.

In addition, the present embodiment has the same advantageous effects as the first embodiment.

Sixth Embodiment

Figure 14:
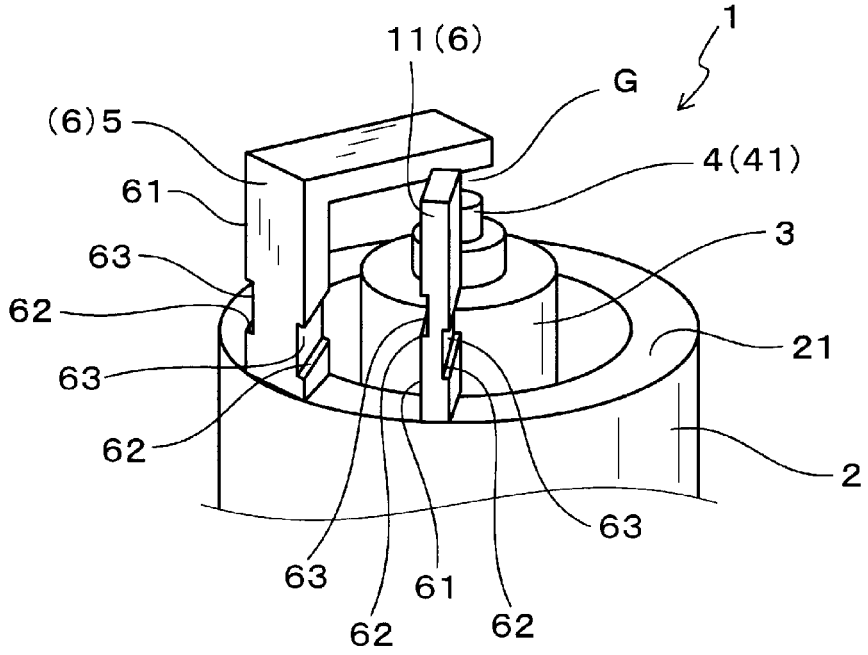
FIG. 14 is a perspective view of a distal part of a spark plug according to a sixth embodiment.
Figure 15:
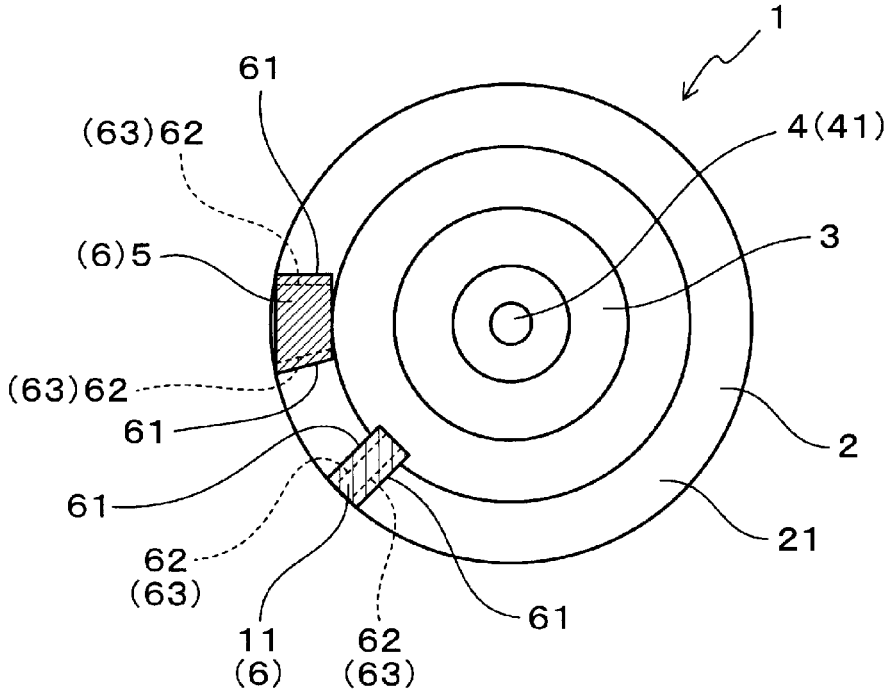
FIG. 15 is a partially cross-sectional view of the distal part of the spark plug according to the sixth embodiment viewed along the plug axial direction.

In this embodiment, as shown in FIGS. 14 and 15, the ground electrode 5 constitutes one standing member 6 and a protruding member 11 provided at a different position from the ground electrode 5 constitutes another standing member 6.

Moreover, each of the two standing members 6 has two guide step portions 62 formed respectively in two side surfaces 61 thereof facing in the plug circumferential direction.

The protruding member 11 has almost the same arrangement and configuration as the protruding member 11 of the spark plug 1 of the fourth embodiment. However, as described above, in the present embodiment, the protruding member 11 has the two guide step portions 62 formed respectively in the two side surfaces 61 thereof.

As shown in FIG. 14, the two guide step portions 62 in the ground electrode 5 and the two guide step portions 62 in the protruding member 11 are each formed as part of a groove portion 63. That is, each of the two standing members 6 has two groove portions 63 formed respectively in the two side surfaces 61 thereof. Moreover, in each of the standing members 6, the two groove portions 63 are formed respectively in opposite side surfaces 61 of the standing member 6 so as to be offset from each other in the plug axial direction.

The other details are the same as in the first embodiment.

In the present embodiment, it is possible to more effectively suppress stagnation of the flow F of the air-fuel mixture in the spark discharge gap G, thereby ensuring a stable ignition performance of the spark plug 1.

In addition, the present embodiment has the same advantageous effects as the fourth embodiment.

Seventh Embodiment

Figure 16:
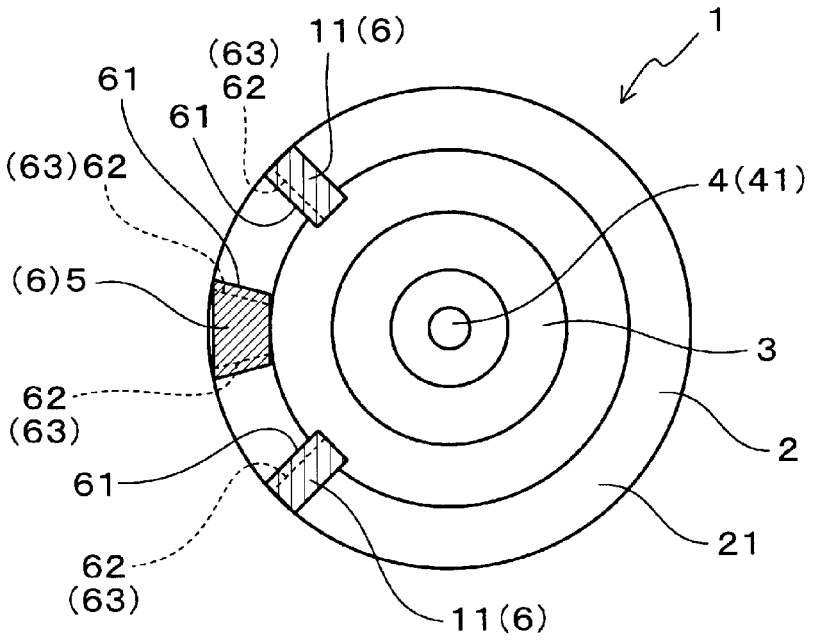
FIG. 16 is a partially cross-sectional view of a distal part of a spark plug according to a seventh embodiment viewed along the plug axial direction.

In this embodiment, as shown in FIG. 16, there are provided two protruding members 11 that are respectively arranged on opposite sides of the ground electrode 5 in the plug circumferential direction.

Moreover, the two protruding members 11 and the ground electrode 5 each constitute a standing member 6 and thus each have one or more guide step portions 62.

Each of the two protruding members 11 has one guide step portion 62 formed in that side surface 61 of the protruding member 11 which faces the ground electrode 5 in the plug circumferential direction. In addition, in the present embodiment, each of the two protruding members 11 has no guide step portion 62 formed in that side surface 61 of the protruding member 11 which is on the opposite side to the ground electrode 5 in the plug circumferential direction.

Moreover, each of the two side surfaces 61 of the ground electrode 5 is slanted so as to make an acute angle with a back surface 512 of the ground electrode 5.

The other details are the same as in the first embodiment.

In the present embodiment, it is possible to more effectively suppress stagnation of the flow F of the air-fuel mixture in the spark discharge gap G, thereby ensuring a stable ignition performance of the spark plug 1.

In addition, the present embodiment has the same advantageous effects as the fourth embodiment.

Eighth Embodiment

Figure 17:
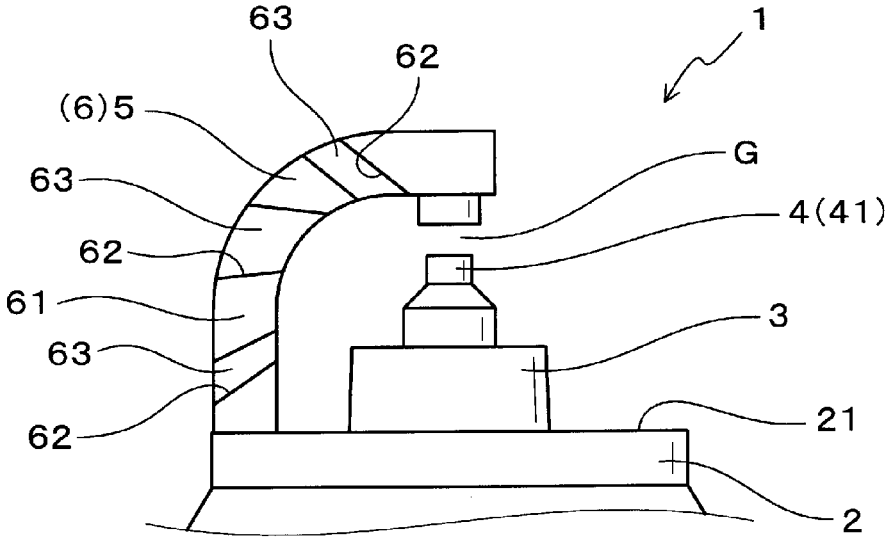
FIG. 17 is a schematic side view of a distal part of a spark plug according to an eighth embodiment.
Figure 18:
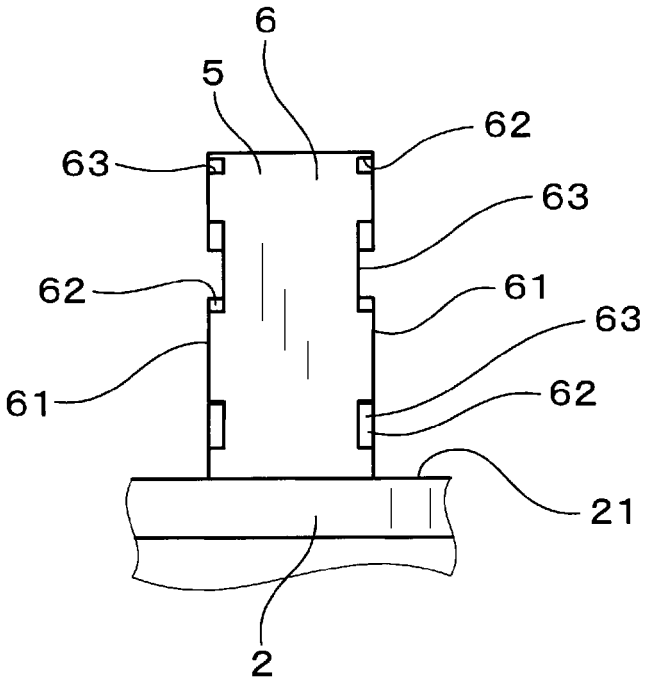
FIG. 18 is a front view, from a radially outer side, of a ground electrode constituting a standing member in the spark plug according to the eighth embodiment.

In this embodiment, as shown in FIGS. 17 and 18, the ground electrode 5 constitutes a standing member 6 and there are provided a plurality of groove portions 63 in the standing member 6 (the ground electrode 5).

That is, in each of two side surfaces 61 of the standing member 6 constituted of the ground electrode 5, there are provided three groove portions 63. In this manner, a plurality of guide step portions 62 are provided.

Each of the guide step portions 62 is slanted so as to approach the spark discharge gap G in the plug axial direction while extending from the radially outer side to the radially inner side.

The other details are the same as in the first embodiment.

In the present embodiment, it is easy to guide the flow F of the air-fuel mixture to the spark discharge gap G over a wide range in the plug axial direction.

In addition, the present embodiment has the same advantageous effects as the first embodiment.

Ninth Embodiment

Figure 19:
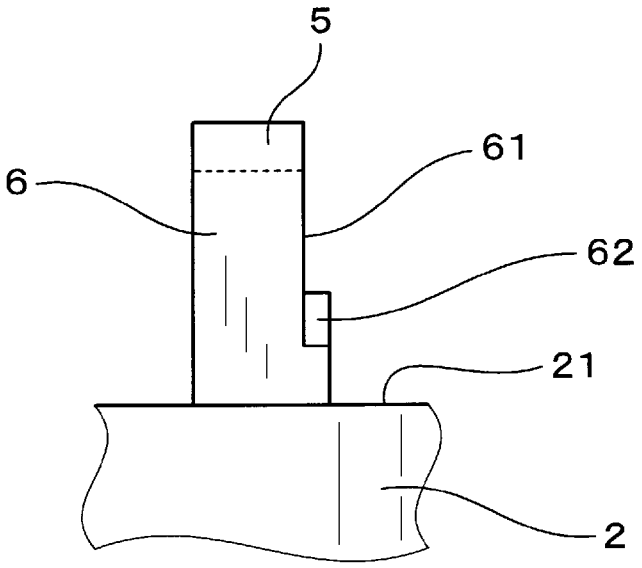
FIG. 19 is a front view, from a radially outer side, of a ground electrode constituting a standing member in a spark plug according to a ninth embodiment.
Figure 20:
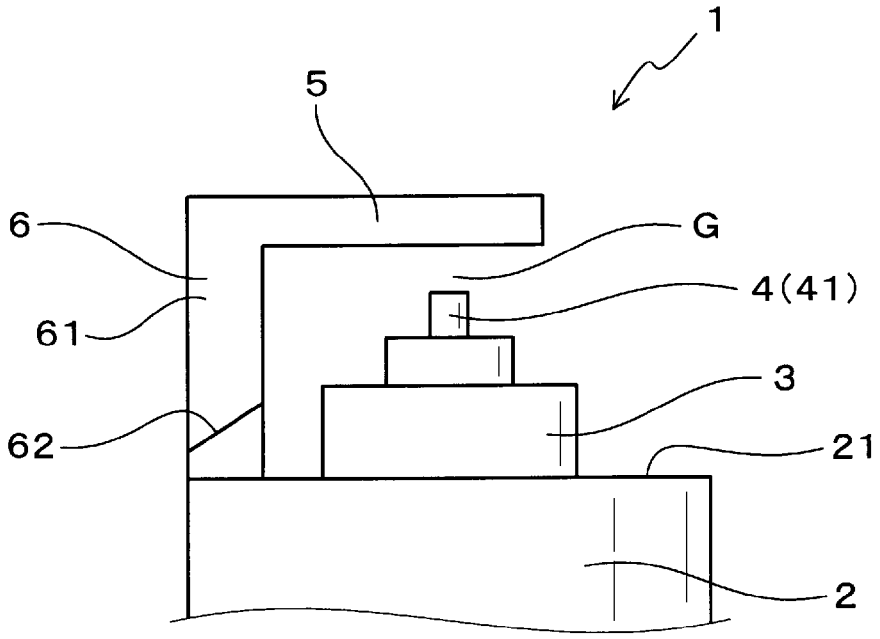
FIG. 20 is a schematic side view of a distal part of the spark plug according to the ninth embodiment.

In this embodiment, as shown in FIGS. 19 and 20, there is provided a standing member 6 that has a guide step portion 62 formed without forming a groove portion.

That is, in the spark plug 1 according to the present embodiment, the guide step portion 62 is formed by providing a level difference on a side surface 61 of the standing member 6 on the proximal side of the spark discharge gap G. Moreover, in the present embodiment, the standing member 6 is constituted of the ground electrode 5.

The other details are the same as in the first embodiment.

In the present embodiment, it is possible to make the shape of the standing member 6 relatively simple, thereby facilitating the manufacture of the spark plug 1.

In addition, the present embodiment has the same advantageous effects as the first embodiment.

Tenth Embodiment

Figure 21:
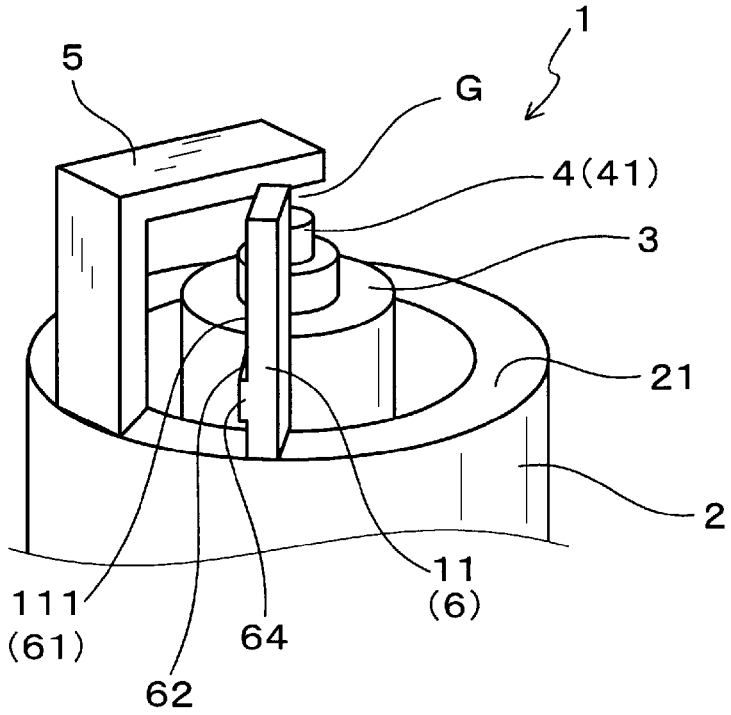
FIG. 21 is a perspective view of a distal part of a spark plug according to a tenth embodiment.
Figure 22:
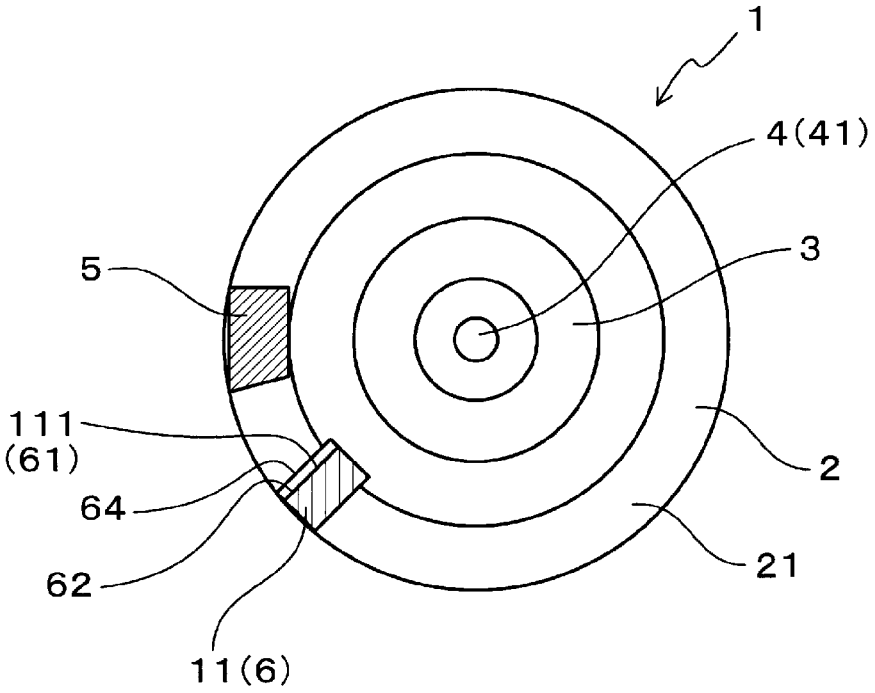
FIG. 22 is a partially cross-sectional view of the distal part of the spark plug according to the tenth embodiment viewed along the plug axial direction.
Figure 23:
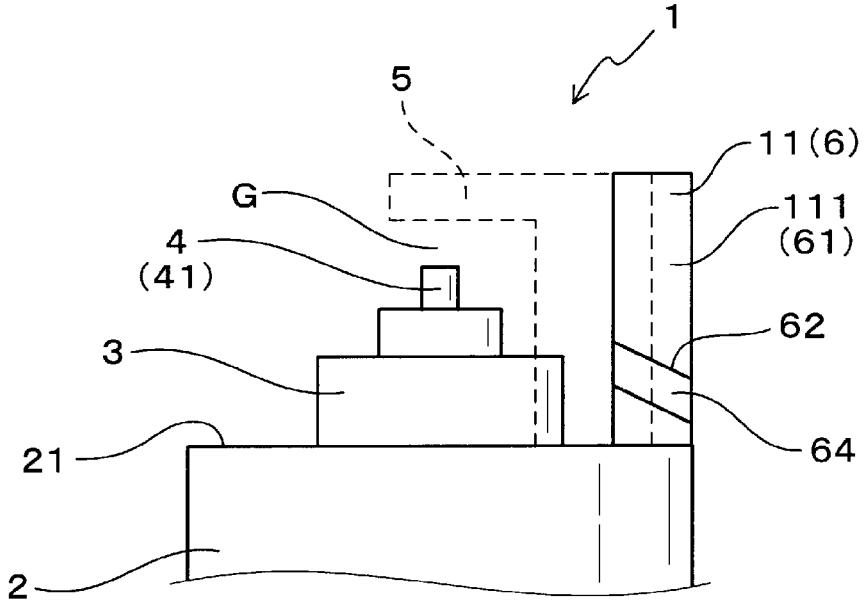
FIG. 23 is a schematic side view of the distal part of the spark plug according to the tenth embodiment.

In this embodiment, as shown in FIGS. 21-23, a guide step portion 62 is formed by providing a protrusion 64 on a side surface 61 of a standing member 6.

That is, in the present embodiment, the guide step portion 62 is constituted of part of the protrusion 64 that protrudes from the side surface 61 of the standing member 6.

In the present embodiment, the protrusion 64 is provided proximalward from the spark discharge gap G in the plug axial direction. Moreover, as shown in FIG. 23, the protrusion 64 is slanted so as to approach the spark discharge gap G in the plug axial direction while extending from the radially outer side to the radially inner side. A distal side surface of the protrusion 64 constitutes the guide step portion 62.

Moreover, in the present embodiment, the standing member 6 is constituted of a protruding member 11 that stands (protrudes), at a different position from the ground electrode 5, from the housing 2. The guide step portion 62 is formed as part of the protrusion 64 on a guide surface 111 (side surface 61) of the protruding member 11.

The other details are the same as in the fourth embodiment. In addition, FIG. 23 is a side view, from a normal direction to the side surface 61, of a distal part of the spark plug 1; however, for the sake of convenience, the side view is provided in the state of seeing through the ground electrode 5 and the ground electrode 5 only has its contour shown with dashed lines therein.

In the present embodiment, it is possible to increase the thickness of the standing member 6 in the plug circumferential direction at the portion where the protrusion 64 is provided, thereby making it easy to ensure the strength of the standing member 6 in the vicinity of the guide step portion 62.

In addition, the present embodiment has the same advantageous effects as the fourth embodiment.

Eleventh Embodiment

Figure 24:
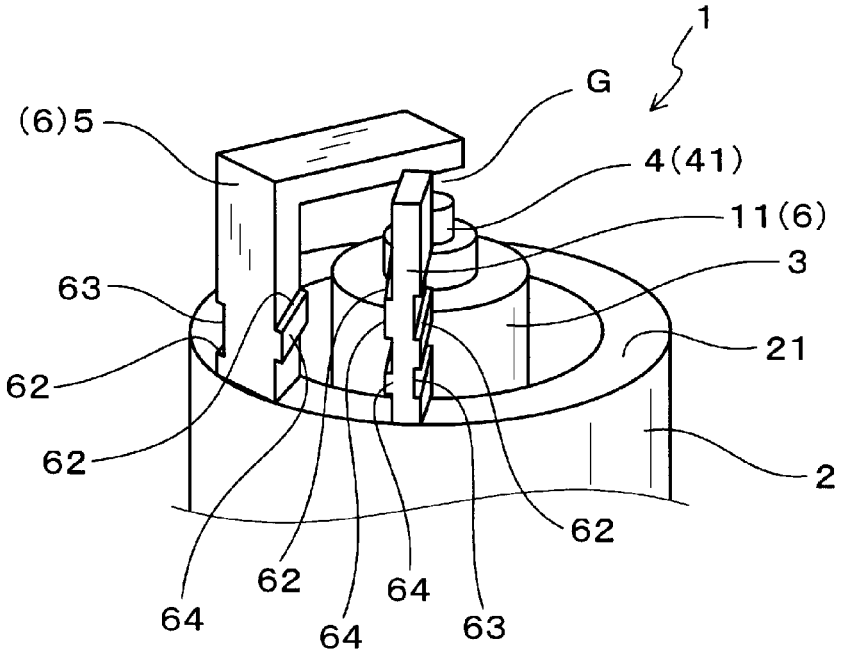
FIG. 24 is a perspective view of a distal part of a spark plug according to an eleventh embodiment.

In this embodiment, as shown in FIG. 24, groove portions 63 and protrusions 64 are provided in standing members 6.

In the present embodiment, the ground electrode 5 (one standing member 6) has a groove portion 63 and a protrusion 64 provided respectively in a pair of side surfaces 61 thereof. A protruding member 11 (another standing member 6) has two protrusions 64 provided on one side surface 61 thereof and two groove portions 63 provided on the other side surface 61 thereof. In this manner, guide step portions 62 are provided in each of the standing members 6.

The others have the same configuration and provide the same advantageous effects as in the first embodiment.

Twelfth Embodiment

Figure 25:
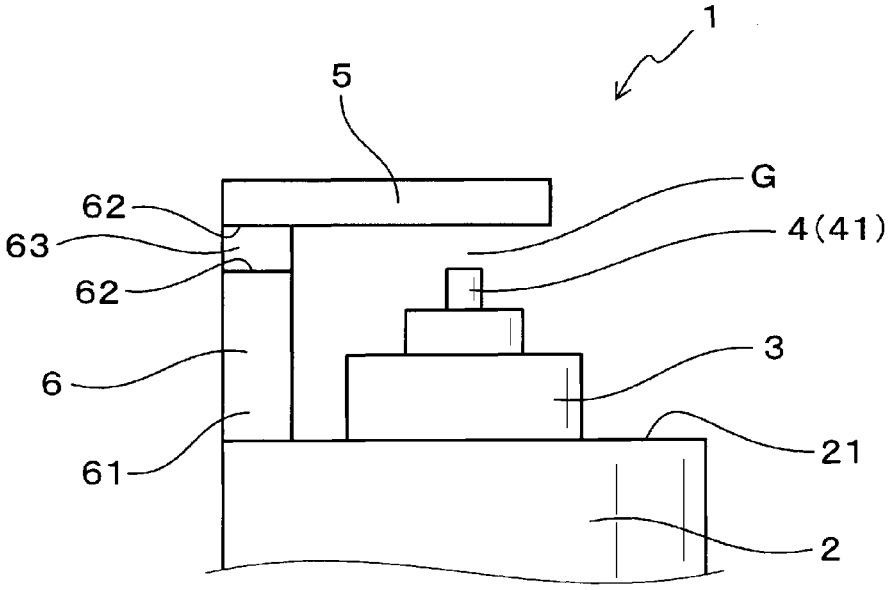
FIG. 25 is a schematic side view of a distal part of a spark plug according to a twelfth embodiment.

In this embodiment, as shown in FIG. 25, a guide step portion 62 is formed along a direction perpendicular the plug axial direction.

That is, in the spark plug 1 according to the present embodiment, the guide step portion 62 is provided at the same position in the plug axial direction as the spark discharge gap G. The guide step portion 62 is formed along a direction toward the spark discharge gap G and substantially perpendicular to the plug axial direction. Moreover, in the present embodiment, the guide step portion 62 is formed as part of a groove portion 63.

The other details are the same as in the first embodiment.

In the present embodiment, of the flow of the air-fuel mixture flowing from the radially outer side to the radially inner side along the side surfaces 61 of the standing member 6, the flow of the air-fuel mixture at the same position in the plug axial direction as the spark discharge gap G can be reliably guided to the spark discharge gap G.

In addition, the present embodiment has the same advantageous effects as the first embodiment.

The present invention is not limited to the above-described embodiments and can be carried out in various modes. Moreover, the present invention can also be carried out in a mode that is a suitable combination of two or more of the above-described embodiments.

DESCRIPTION OF REFERENCE SIGNS

1 spark plug for internal combustion engine
2 housing
21 distal end portion (of the housing)
3 insulator
4 center electrode
41 distal end portion (of the center electrode)
5 ground electrode
6 standing member
61 side surfaces
62 guide step portion
G spark discharge gap

The invention claimed is:

1. A spark plug for an internal combustion engine, comprising:

a tubular housing;

a tubular insulator held inside the housing;

a center electrode held inside the insulator such that a distal end portion protrudes; and a ground electrode that forms a spark discharge gap between it and the center electrode, wherein the spark plug further comprises a standing member that stands distalward from a distal end portion of the housing, in at least one of a pair of side surfaces of the standing member which face in a plug circumferential direction, there is formed a guide step portion for guiding flow of an air-fuel mixture in a combustion chamber of the internal combustion engine to the spark discharge gap the guide step portion is constituted of part of a groove portion formed in the side surface of the standing member, and the groove portion is shaped so as to be deepened while extending from a radially outer side to a radially inner side.

2. The spark plug for an internal combustion engine as set forth in claim 1, wherein the standing member is constituted of the ground electrode.

3. The spark plug for an internal combustion engine as set forth in claim 1, further comprising a protruding member that stands from a different position at the distal end portion of the housing from the ground electrode.

4. The spark plug for an internal combustion engine as set forth in claim 3, wherein the standing member is constituted of the protruding member.

5. The spark plug for an internal combustion engine as set forth in claim 1, wherein the guide step portion is slanted so as to approach the spark discharge gap (G) in a plug axial direction while extending from the radially outer side to the radially inner side.

6. The spark plug for an internal combustion engine as set forth in claim 1, wherein the guide step portion is formed in each of the pair of side surfaces of the standing member.

* * * * *